United States Patent [19]

Crover

[11] Patent Number: 4,614,241

[45] Date of Patent: Sep. 30, 1986

[54] IMPACT TOOL ASSEMBLY WITH BIT ISOLATING MEANS

[75] Inventor: Stephen E. Crover, Boring, Oreg.

[73] Assignee: The Stanley Works, New Britain, Conn.

[21] Appl. No.: 580,602

[22] Filed: Feb. 15, 1984

[51] Int. Cl.[4] ..... B23B 45/16

[52] U.S. Cl. ..... 173/139; 173/133

[58] Field of Search ..... 173/139, 133, 137, 128; 279/19.6, 19.7

[56] References Cited

U.S. PATENT DOCUMENTS

| | | | |
|---|---|---|---|
| 1,470,622 | 10/1923 | Jimerson . | |
| 1,481,641 | 1/1929 | Jimerson . | |
| 1,774,905 | 9/1930 | Smrdel . | |
| 2,185,471 | 1/1940 | Mall . | |
| 2,239,090 | 4/1941 | Everett | 173/128 X |
| 2,685,274 | 8/1954 | Liddicoat | 173/139 |
| 3,179,185 | 4/1965 | O'Farrell . | |
| 3,244,241 | 4/1966 | Ferwerda . | |
| 3,266,581 | 8/1966 | Cooley et al. . | |
| 4,133,394 | 1/1979 | Wohlwend . | |
| 4,168,751 | 9/1979 | Deike . | |

FOREIGN PATENT DOCUMENTS

| | | | |
|---|---|---|---|
| 2303645 | 12/1976 | France | 173/139 |

*Primary Examiner*—E. R. Kazenske
*Assistant Examiner*—Willmon Fridie, Jr.

[57] ABSTRACT

A foot assembly for an impact tool reduces tool bit rebound shock to the operator and minimizes tool bit bouncing on the work surface by isolating and attenuating energy reflected from the work surface through the tool bit. The unique system comprises a collar support fabricated from a tough elastomeric material, which engages the inserted inner end of the tool bit and is maintained firmly against the collar thereof by a coil spring. Mounted inwardly within the longitudinal passageway of the foot assembly housing is a bushing, which has an outer contact surface against which the collar support will be thrust by the inwardly moving bit, the elastomeric material thereby serving to attenuate the rebound energy.

6 Claims, 6 Drawing Figures

IMPACT TOOL ASSEMBLY WITH BIT ISOLATING MEANS

BACKGROUND OF THE INVENTION

It is common practice to provide cushioning members in percussion or impact tools, such as power hammers, concrete breakers, and the like. Tools having such members are described, for example, in the following U.S. Pat. Nos. 1,470,622 and 1,481,641 to Jimerson; 1,774,905 to Smrdel; 2,185,471 to Mall; 3,179,185 to O'Farrell; 3,244,241 to Ferwerda; 3,266,581 to Cooley et al; 4,133,394 to Wohlwend; and 4,168,751 to Deike. Despite the level of developmental activity evidenced by these patents, a need remains for a system for effectively absorbing and attentuating shock and vibration in impact tools, to reduce bouncing and thereby make them easier to control. The high levels of sound produced during use are also, of course, a most undesirable characteristic of such power driven tools.

Accordingly, it is a primary object of the present invention to provide a novel foot assembly for an impact tool, and a tool incorporating the same, having means therein for absorbing the kinetic energy that is reflected from the work surface through the tool bit, and for reducing the noise produced during use thereof.

It is a more specific object of the invention to provide such an assembly and tool wherein an elastomeric damping member serves to reduce shock, recoil, and vibration.

Additional objects of the invention are to provide a foot assembly and tool of relatively simple and yet highly effective construction, affording the foregoing features and advantages.

SUMMARY OF THE DISCLOSURE

It has now been found that certain of the foregoing and related objects of the invention are readily attained in a foot assembly for an impact tool, comprising an elongated housing having a passageway extending longitudinally therethrough, from a tool bit end to a drive end, and means within the passageway providing an abutment surface facing the tool bit end of the housing. A tough, elastomeric damping member, having a contact surface on its outer end, is slidably mounted within the passageway of the housing between the abutment surface and the tool bit end, and has a bore which is axially aligned with at least a section of the passageway lying adjacent the abutment surface. The bore of the damping member and the passageway section are dimensioned and configured to receive the inner end portion of a tool bit inserted axially from the tool bit end of the housing, with the passageway section being dimensioned and configured to permit sliding of the associated tool bit end portion therein. Within the housing is also included limiting means spaced from the abutment surface toward the tool bit end a distance sufficient to permit limited travel of the damping member therebetween, and biasing means acting upon the inner end portion of the damping member to urge it away from the abutment surface. Thus, kinetic energy reflected back from the work surface through an associated tool bit operatively mounted in the housing will be transmitted to, and attenuated by, the damping member through contact with a stop element on the bit, with the biasing means serving to maintain the damping member in position thereagainst.

In the preferred embodiments, the means providing the abutment surface will comprise a generally cylindrical bushing mounted within the passageway of the housing inwardly of the damping member, with the bore through the bushing providing the passageway section. The outer end portion of the bushing may be spaced radially from the corresponding wall portion of the housing to define an inwardly-extending circumferential recess therebetween, within which may be mounted the inner end portion of a compression coil spring, to provide the biasing means of the assembly. The damping member will advantageously also be of generally cylindrical configuration to provide a substantially annular contact surface for cooperating with a circumferential collar portion of the tool bit, and most desirably the damping member will have at least one ring of wear-resistant material extending circumferentially thereabout and exposed on its outside surface, to maximize the useful life of the member.

Other objects of the invention are attained by the provision of an impact tool comprising a drive mechanism operatively engaged with the drive end of the foot assembly housing, including a hammer and means for reciprocating it substantially along the axis of alignment of the passageway section and damping member bore. The hammer will be so positioned as to enable repetitive direct impact upon the inner end of a tool bit, inserted as hereinabove described.

DETAILED DESCRIPTION OF THE ILLUSTRATED EMBODIMENTS

Figure 1:
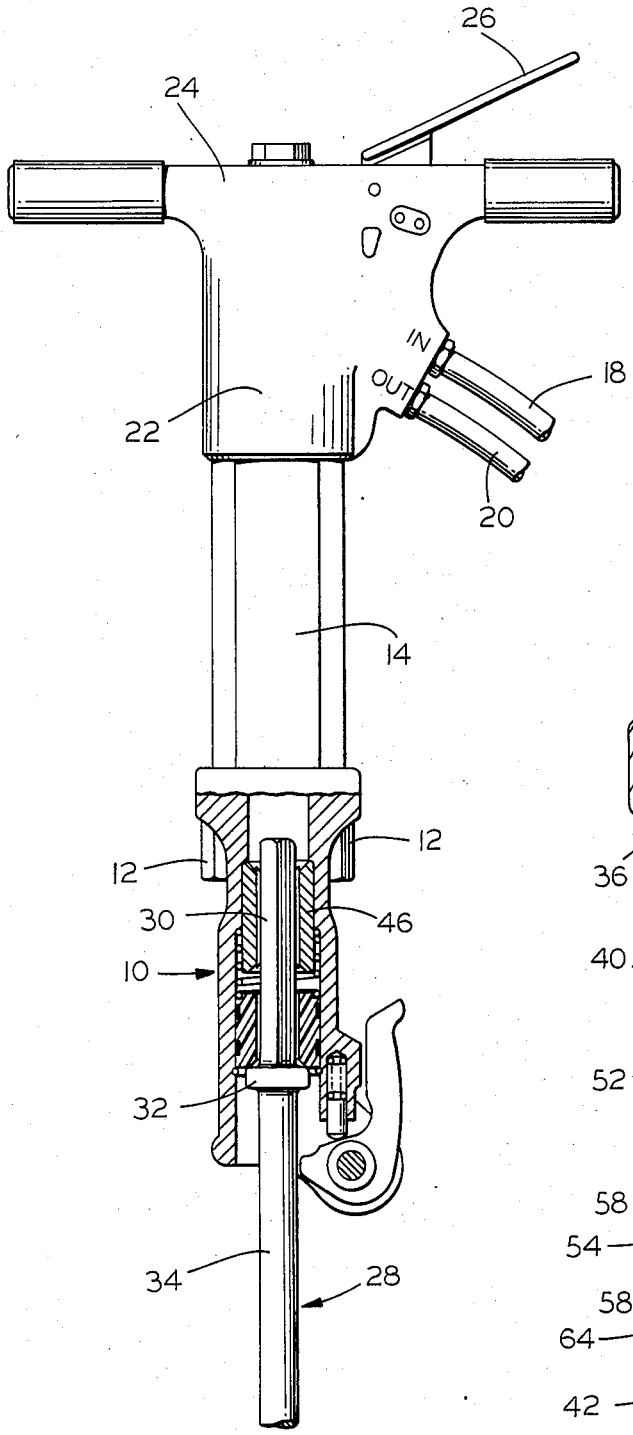
FIG. 1 is a side-elevational view of an impact tool embodying the present invention, with the foot assembly thereof shown in partial section and with a fragmentarily illustrated associated tool bit inserted thereinto.
Figure 2:
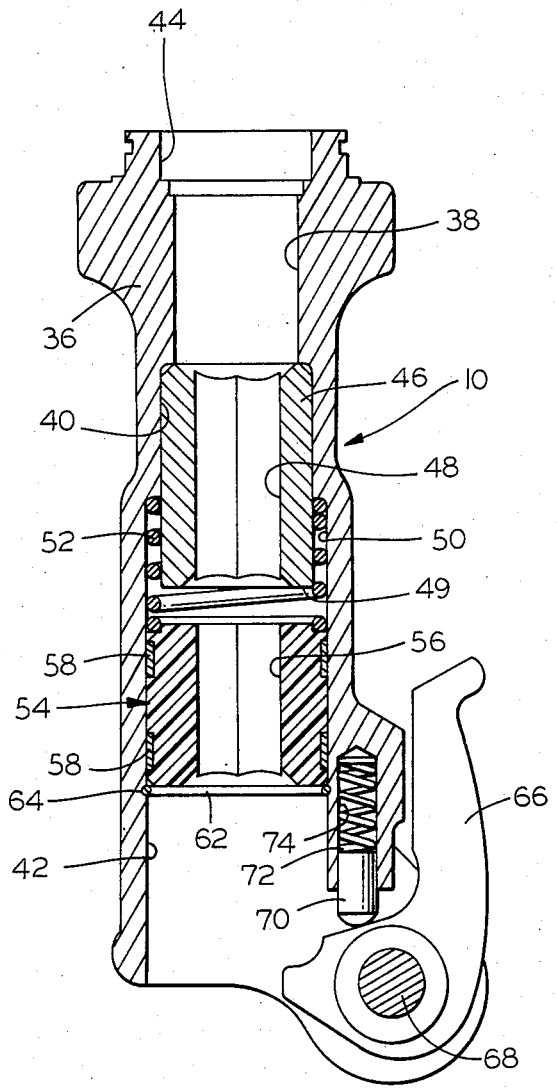
FIG. 2 is a cross sectional view of the foot assembly utilized in the impact tool of FIG. 1, drawn to an enlarged scale.

Turning initially to FIGS. 1 and 2 of the drawings, therein illustrated are an impact tool and a foot assembly, respectively, embodying the present invention. The foot assembly, generally designated by the numeral 10, is affixed by nuts 12 upon the lower end of the tool body portion 14. The latter contains a hammer 16 (seen in FIGS. 4 and 5), with means (not shown) for operating it by the force of hydraulic fluid introduced and discharged through the inlet and outlet hoses 20, 18 connected to the back head portion 22 of the tool. The latter is configured to provide a tansverse handle portion 24, and an actuating lever 26 serves to control the flow of fluid for powering the hammer, in a conventional manner. A concrete breaker tool bit, generally designated by the numeral 28, has an inner end portion 30 inserted axially into the foot assembly 10 and separated from the outer, spike portion 34 by the circumferential collar portion 32.

The assembly 10 includes an elongated housing 36 with a passageway of compound circular cross-sectional configuration extending longitudinally through it. The passageway consists of a throat section 38, a somewhat larger intermediate section 40, and a further enlarged outer end section 42; a compound counterbore section 44 is formed at the inner end of the passageway adjacent to the throat section 38.

A bushing 46, having a bore 48 of hexagonal cross-section, is affixed within the intermediate section 40 of the housing passageway to slidably receive the correspondingly configured inner portion 30 of the tool bit 28. As can be seen, the lower portion of the bushing 46 protrudes into the enlarged section 42 of the passageway, and provides a generally annular abutment surface 49 facing the tool bit end of the housing; it also defines therewith an inwardly extending circumferential recess 50. A compression coil spring 52 is mounted upon the protruding end of the bushing 46 with its inner end portion disposed within the recess 50, and is thereby securely seated within the enlarged passageway section 42.

Figure 6:
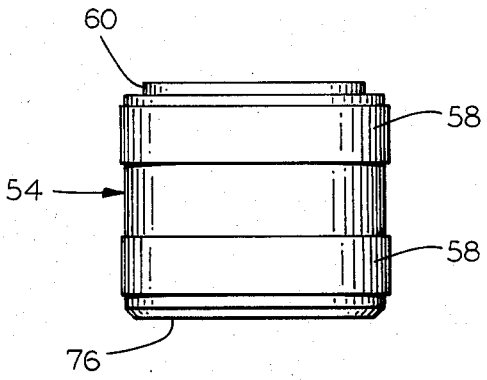
FIG. 6 is a side elevational view of the collar support, or elastomeric damping member, utilized in the foot assembly of the invention, and drawn to a scale further enlarged from that of FIGS. 2–5.

The opposite end portion of the spring 52 bears upon a collar support or damping member, which is generally designated by the numeral 54 and is shown in full view in FIG. 6. The collar support 54 is fabricated from a tough, elastomeric material, and has a pair of integral, wear-resistant annular strip bearing 58 exposed on its outer surface. A bore 56 is formed through the member 54 in alignment with the bore 48 of the bushing 46; it is of hexagonal cross-sectional configuration, and is dimensioned to frictionally engage the inserted portion 30 of the tool bit, for movement therewith (in the drawing, the size of the bore 56 is exaggerated, for clarity of illustration). A circumferential shoulder portion 60 is provided on the inner end of the damping member for seating the coil spring 52, and a generally annular contact surface 76 is provided by the opposite end. Spring 52 biases the collar support 54 in the direction of the tool bit end of the housing to the limit of travel, which is defined by the retaining ring 62; the ring is snap fit into a small circumferential groove 64, machined into the inner surface of the housing 36 within the passageway section 42.

A latch is pivotably mounted by a bolt 68 upon the outer end of the housing 36. Detent 70 is urged against the latch 66 by the coil spring 72, both of which are mounted within a small bore 74 formed longitudinally into the housing 36. The detent biases the latch toward its closed position, as shown, and the latch 66 functions in a conventional manner to permit insertion, retention, and release of the tool bit 28.

Figure 3:
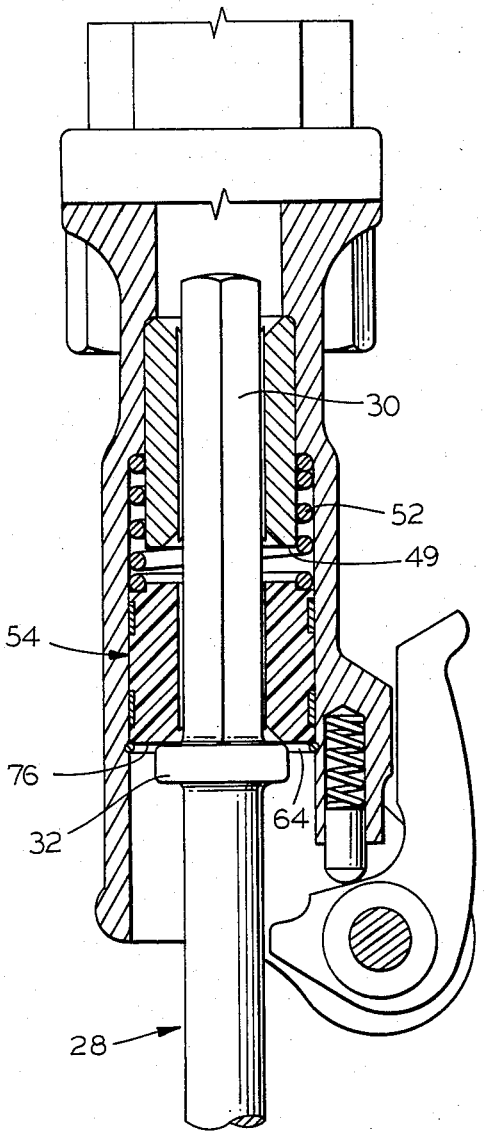
FIG. 3 is a fragmentary elevational view of the lower portion of the tool of FIG. 1, drawn to the scale of FIG. 2 and showing the unloaded positions of the components.

FIGS. 1 and 3 depict the impact tool in its unloaded condition; i.e., they show the positions assumed by the components in the absence of any load due to the mass of the tool itself, the weight of the operator, or under the force of an external device. The damping member 54 is urged by the spring 52 away from the abutment surface 49, so that its contact surface 76 bears upon the internal retaining ring 62.

Figure 4:
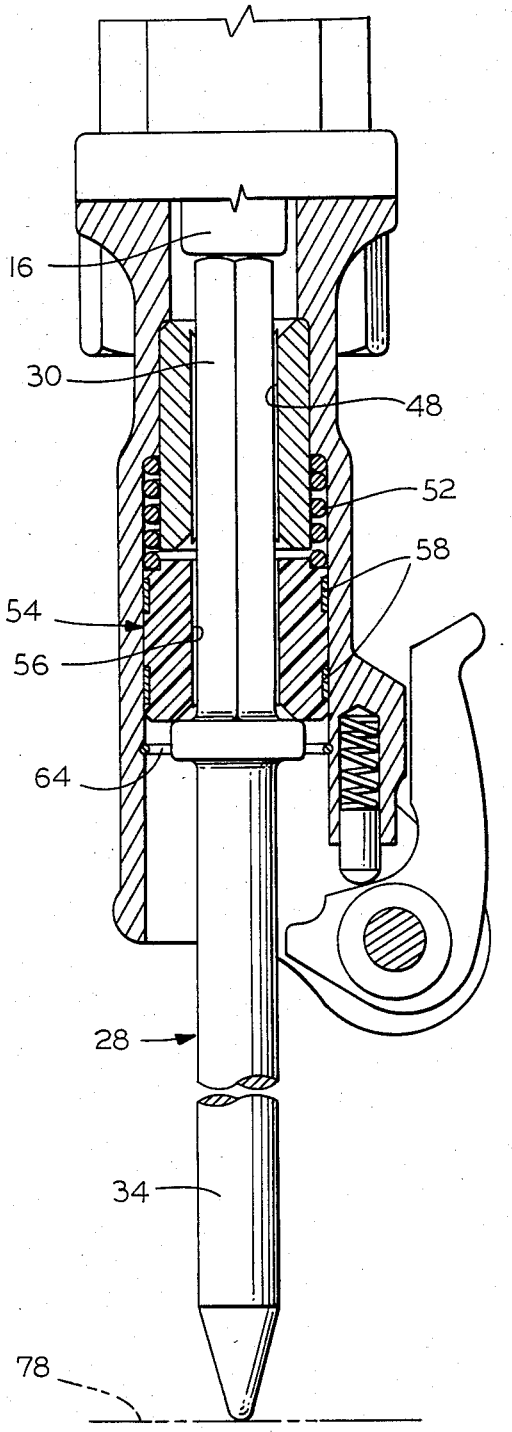
FIG. 4 is a view similar to that of FIG. 3, showing the positions of the components in a normal operating position of the tool.

The normal operating position of the impact tool is illustrated in FIG. 4, with the tool bit 28 held against the work surface 78 by the spring 52, acting upon the collar support 54. In operation, the hammer 16 strikes the top of the inner end portion 32 of the tool bit to transfer the impact energy to the work surface; energy reflected back therefrom is substantially absorbed by the elastomeric material of the collar support 54. The spring 52 serves to help maintain the collar support 54 in position firmly against the stop element 32, as well as to resist inward tool bit movement and store or absorb energy reflected by the tool bit.

The effect of the damping system is to isolate the tool bit, to thereby reduce the shock and vibration transmitted to the operator, and in turn increase control by maintaining the bit in a practically stationary condition on the work surface during initiation of an operating cycle. As will be appreciated, after the cycle has continued and a substantial cavity has been formed into the surface, control of the bit becomes significantly less difficult. The system also reduces the tendency for the bit to become lodged when driven into the work surface, and the sound level is substantially reduced because the tool bit is restrained from vibrating or "ringing" when impacted by the hammer 16.

Figure 5:
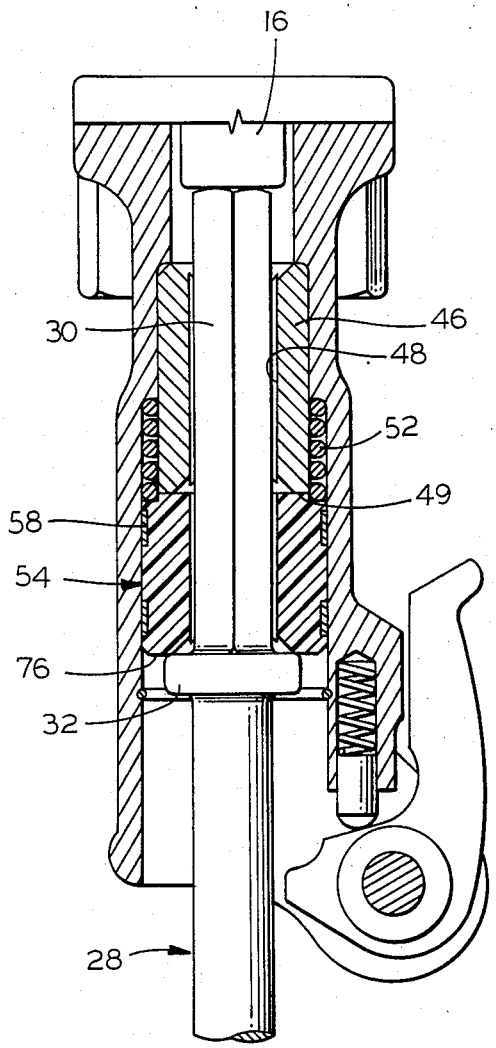
FIG. 5 is another similar view of the tool, depicting the positions of the components under full compression.

Finally, FIG. 5 shows the fully compressed positions of the spring 52 and the collar support 54, with the latter bearing upon the abutment surface 49 of the bushing 46. The elastomer of the collar support most effectively attentuates reflected rebound energy and vibration in this condition.

Although a hydraulic impact tool has been illustrated, it will be appreciated that the hammer may be driven by electric or pneumatic means, if so desired. Moreover, the coil spring used to bias the collar support could be replaced by equivalent pneumatic or hydraulic means, in appropriate circumstances. The materials of construction for the various components of the foot assembly of the invention will be evident to those skilled in the art, particularly in view of the foregoing description. Obviously, the assembly will be made primarily of steel, parts of which (e.g., the bushing) may be hardened or otherwise treated as appropriate to provide necessary properties. The collar support member may be fabricated from any suitable tough elastomeric material, synthetic resinous materials such as polyurethane being particularly suitable; for example, a thermosetting elastomeric polyurethane of 85–100 Shore A hardness, 2800 psi minimum tensile strength, 580 percent elongation, and minimum Bayshore resilience of 38 percent, has been found to be especially effective. The wear rings formed on the collar support member may also be made of any appropriate low friction material, exemplary materials being glass reinforced nylon containing polytetrafluoroethylene resin (Teflon), bronze or glass filled Teflon, and the like.

Thus, it can be seen that the present invention provides a novel foot assembly for an impact tool, and a tool incorporating the same, having means therein for absorbing the kinetic energy that is reflected from a work surface, and for reducing the noise produced during use thereof. The foot assembly and impact tool of the invention are of relatively simple and yet highly effective construction, and incorporate an elastomeric damping member which serves to reduce shock, recoil, and vibration.

Having thus described the invention, what is claimed is:

1. An impact tool comprising: (a) an elongated foot assembly housing having a passageway extending longitudinally therethrough from a tool bit end to a drive end, said housing including a generally cylindrical bushing mounted within said passageway of said housing at a point spaced from said tool bit end and providing an abutment surface within said passageway facing said tool bit end of said housing, said bushing having an axial bore extending therethrough; a tough, elastomeric damping member slidably mounted within said passageway of said housing between said abutment surface and said tool bit end, said damping member having a contact surface on its end facing said tool bit end of said housing and an axial bore extending therethrough, said bore of said damping member and at least a section of said adjacent said abutment surface being axially aligned and being dimensioned and configured to receive the inner end portion of an associated tool bit inserted axially therein from said tool bit end of said housing, said section of said bore in said bushing being dimensioned and configured to permit sliding movement of the associated tool bit end portion therein; means in said housing for limiting the movement of said damping member toward said tool bit end of said housing, said limiting means being spaced from said abutment surface of said bushing a distance sufficient to permit limited travel of said damping member therebetween; and a coiled compression spring in said housing acting upon said damping member to bias said member away from said abutment surface of said bushing and toward said tool bit end of said housing, the end portion of said bushing adjacent said damping member being spaced radially from the laterally adjacent wall portion of said housing to define a circumferential recess therebetween, said spring having one end extending about said bushing within said recess to permit compression of said spring therein during movement of the associated tool bit and thereby said damping member towards said abutment surface; and (b) a drive mechanism operatively engaged with the drive end of said housing and including a hammer and means for reciprocating said hammer substantially along the axis of alignment of said section of said bushing bore and said damping member bore, said hammer being positioned for repetitive direct impact upon the inner end of an associated tool bit inserted from said tool bit end of said housing through said damping member bore and of said bushing bore section; whereby an associated tool bit having a stop element spaced from its inner end can be so mounted in said housing for impact by said hammer, and whereby said spring will store energy and tend to maintain said damping member in position against the stop element of the associated tool bit, so that kinetic energy reflected back from the work surface through the associated tool bit will be transmitted to, and attenuated by, said damping member and will be transmitted to said housing at a reduced level, nearly stationary controlled contact of the associated tool bit with the work surface thereby being maintained.

2. A foot assembly for an impact tool comprising: an elongated housing having a passageway extending longitudinally therethrough from a tool bit end to a drive end, said housing including a generally cylindrical bushing mounted within said passageway of said housing at a point spaced from said tool bit end and means providing an abutment surface within said passageway facing said tool bit end of said housing, said bushing having an axial bore extending therethrough; a tough, elastomeric camping member slidably mounted within said passageway of said housing between said abutment surface and said tool bit end, said damping member having a contact surface on its end facing said tool bit end of said housing and an axial bore extending therethrough, said bore of said damping member and at least a section of said bore of said bushing adjacent said abutment surface being axially aligned and being dimensioned and configured to receive the inner end portion of an associated tool bit inserted axially therein from said tool bit end of said housing, said section of said bore in said bushing being dimensioned and configured to permit sliding movement of the associated tool bit end portion therein; means in said housing for limiting the movement of said damping member toward said tool bit end of said housing, said limiting means being spaced from said abutment surface of said bushing a distance sufficient to permit limited travel of said damping member therebetween; and a coiled compression spring in said housing acting upon the said damping member to urge said member away from said abutment surface of said bushing and towards said tool bit end of said housing, the end portion of said bushing adjacent said damping member being spaced radially from the laterally adjacent wall portion of said housing to define a circumferential recess therebetween, said spring having one end extending about said bushing within said recess to permit compression of said spring therein during movement of the associated tool bit and thereby said damping member towards said abutment surface; whereby an associated tool bit having a stop element spaced from its inner end can be mounted in said housing by insertion from said tool bit end thereof through said damping member bore and section of said bushing bore, for impact by the reciprocating hammer of an associated drive mechanism operatively engaged with the drive end of said housing, and whereby said spring will store energy and tend to maintain said damping member in position against the stop element of the associated bit, so that kinetic energy reflected back from the work surface through the associated tool bit will be transmitted to, and attenuated by, said damping member, and will be transmitted to said housing at a reduced level, nearly stationary controlled contact of the associated tool bit with the work surface thereby being maintained.

3. A foot assembly for an impact tool comprising: an elongated housing having a passageway extending longitudinally therethrough from a tool bit end to a drive end, said housing including a bushing seated within said passageway at a point spaced from said tool bit end and providing an abutment surface within said passageway facing said tool bit end of said housing, said bushing having an axial bore extending therethrough; a tough, elastomeric damping member slidably mounted within said passageway of said housing between said abutment surface and said tool bit end, said damping member having a contact surface on its end facing said tool bit end of said housing and an axial bore extending therethrough, said bore of said damping member and at least a section of said bore of said bushing adjacent said abutment surface being axially aligned and being dimensioned and configured to receive the inner end portion of an associated tool bit inserted axially therein from said tool bit end of said housing, said section of said bore in said bushing being dimensioned and configured to permit sliding movement of the associated tool bit end portion therein; means in said housing for limiting the movement of said damping member toward said tool bit end of said housing, said limiting means being spaced from said abutment surface of said bushing a distance sufficient to permit limited travel of said damping member therebetween; and a compression spring in said housing acting upon said damping member to urge said member away from said abutment surface of said bushing and toward said tool bit end of said housing, said compression spring having at least one end seated within a recess to permit compression at said spring therein during movement of the associated tool bit and thereby said damping member towards said abutment surface, whereby an associated tool bit having a stop element spaced from its inner end can be mounted in said housing by insertion from said tool bit end thereof through said damping member bore and section of said bushing bore, for impact by the reciprocating hammer of an associated drive mechanism operatively engaged with the drive end of said housing, and whereby said spring will store energy and tend to maintain said damping member in position against the stop element of the associated bit, so that kinetic energy reflected back from the work surface through the associated tool bit will be transmitted to, and attenuated by, said damping member, and will be transmitted to said housing at a reduced level, nearly stationary controlled contact of the associated bit with the work surface thereby being maintained.

4. The assembly of claim 1 wherein said damping member is of generally cylindrical configuration, and includes at least one ring of wear-resistant material extending circumferentially thereabout and exposed on the outside surface thereof, said contact surface of said damping member being substantially annular to cooperate with a circumferential collar providing the stop element on the associated tool bit.

5. An impact tool comprising: (a) an elongated foot assembly housing having a passageway extending longitudinally therethrough from a tool bit end to a drive end, said housing including a bushing seated within said passageway at a point spaced from said tool bit end and providing an abutment surface within said passageway facing said tool bit end of said housing, said bushing having an axial bore extending therethrough; a tough, elastomeric damping member slidably mounted within said passageway of said housing between said abutment surface and said tool bit end, said damping member having a contact surface on its end facing said tool bit end of said housing and an axial bore extending therethrough, said bore and at least a section of said bore of said bushing adjacent said abutment surface being axially aligned and being dimensioned and configured to receive the inner end portion of an associated tool bit inserted axially therein from said tool bit end of said housing, said section of said bore in said bushing being dimensioned and configured to permit sliding movement of the associated tool bit end portion therein; means in said housing for limiting the movement of said damping member toward said tool bit end of said housing, said limiting means being spaced from said abutment surface of said bushing a distance sufficient to permit limited travel of said damping member therebetween; and a compression spring in said housing acting upon said damping member to bias said member away from said abutment surface of said bushing and toward said tool bit end of said housing, said compression spring having at least one end seated within a recess and to permit compression of said spring therein during movement of the associated tool bit and thereby said damping member towards said abutment surface; and (b) a drive mechanism operatively engaged with the drive end of said housing and including a hammer and means for reciprocating said hammer substantially along the axis of alignment of said section of said bore in said bushing and said damping member bore, said hammer being positioned for repetitive direct impact upon the inner end of a tool bit inserted from said tool bit end of said housing through said damping member bore and passageway section, whereby an associated tool bit having a stop element spaced from its inner end can be so mounted in said housing for impact by said hammer, and whereby said spring will store energy and tend to maintain said damping member in position against the stop element of the bit, so that kinetic energy reflected back from the work surface through the tool bit will be transmitted to, and attenuated by, said damping member and will be transmitted to said housing at a reduced level, nearly stationary controlled contact of the associated bit with the work surface thereby being maintained.

6. The tool of claim 5 wherein said damping member is of generally cylindrical configuration, and includes at least one ring of wear-resistant material extending circumferentially thereabout and exposed on the outside surface thereof, said contact surface of said damping member being generally annular to cooperate with a circumferential collar portion providing the stop element on the associated tool bit.

* * * * *